United States Patent [19]

Nealis

[11] 4,321,873

[45] Mar. 30, 1982

[54] INTERLOCKING MODULAR TABLE UNIT

[76] Inventor: Perry M. Nealis, P.O. Box 36, Blue Mounds, Wis. 53517

[21] Appl. No.: 154,437

[22] Filed: May 29, 1980

[51] Int. Cl.[3] ..... A47B 7/02

[52] U.S. Cl. ..... 108/91; 108/101; 108/155; 211/194

[58] Field of Search ..... 108/91, 101, 53.1, 53.3, 108/155, 153, 157, 111; 211/194, 189

[56] References Cited

U.S. PATENT DOCUMENTS

| | | | |
|---|---|---|---|
| 1,989,849 | 2/1935 | Davies | 108/101 |
| 2,362,426 | 11/1944 | Wyatt | 108/91 |
| 3,217,671 | 11/1965 | Walsh | 108/91 |
| 3,334,942 | 8/1967 | Breslow | 108/91 X |
| 3,549,020 | 12/1970 | Von Bohr | 108/91 |
| 3,669,033 | 6/1972 | Murcia | 108/153 X |
| 3,695,190 | 10/1972 | Bucholz | 108/91 |

*Primary Examiner*—William E. Lyddane

*Attorney, Agent, or Firm*—Isaksen, Lathrop, Esch, Hart & Clark

[57] ABSTRACT

A generally rectangular modular table unit is disclosed which is adapted to being stacked to create larger furniture assemblies but is also capable of being assembled so as to stand alone. Each table unit includes four legs (20, 22), a pair of side bars (30, 32) extending along the sides of the unit, and a planar member (44) to form the top of the unit. A pair of top and bottom cross bars (24, 26) extend across the ends of each of the units. The cross bars (24, 26) have rabbetted recesses (28) formed at each of their ends and each is fastenable to the adjacent legs (20, 22) in one of two configurations, one configuration being adapted for interlocking with adjacent table units in a stack while the other configuration is adapted for table units which are intended to stand alone.

10 Claims, 6 Drawing Figures

INTERLOCKING MODULAR TABLE UNIT

TECHNICAL FIELD

The present invention relates to modular table systems in general, and, in particular, to modular table systems which are particularly adapted for stacking and interlocking so as to form large stable furniture assemblies.

DESCRIPTION OF THE PRIOR ART

The prior art is generally cognizant of the use of shelving or other furniture assemblies composed of modular elements. Thus examples are known in the prior art, as for example in U.S. Pat. Nos. 3,549,020, and 3,741,404, of units of furniture constructed by assembly of modular units each of which has a table top and four legs. It has also been known in the art that various other kinds of modular units may be stacked to create furniture assemblies, such as the examples shown in U.S. Pat. Nos. 3,316,862, 3,695,190, and 3,861,327. Interlocking assemblies composed of modular units are often constructed of plastic or other easily workable material so that the various units can be actively interlocked with each other in forming an extremely rigid assembly, as is shown in U.S. Pat. No.3,669,033. Another example of a shelving assembly including stacked units placed one upon another is shown in U.S. Pat. No. 3,217,671.

SUMMARY OF THE INVENTION

The present invention is summarized in that a generally rectangular modular table unit having a pair of sides and a pair of ends includes: a pair of generally horizontal side bars disposed along the sides of the unit; a planar member positioned between the side bars forming a top for the unit; a pair of generally vertical legs at each end of the unit, each of the legs positioned under an end of one of the side bars; and a top and bottom cross bar at each end of the unit, each cross bar positioned horizontally across the respective end of the unit extending between the legs at that end; each of the cross bars having formed on one face thereof a pair of rabbetted recesses, each recess located at an end of the respective cross bar, and each of the cross bars being fastenable to the adjacent legs in one of two configurations, one configuration being with the recesses oriented downwardly so as to form an interlocking structure to aid in stacking the units, the other configuration being with the recesses oriented upwardly so as to form a structure adapted for standing alone.

It is an object of the present invention to provide a modular table unit which is capable of being assembled so as to either stand alone or to be stacked in an interlocking fashion with other similar modular table units.

It is a further object of the present invention to provide such a table unit which is capable of assembly by an unskilled person in either of its configurations and which is capable of being utilized by an unskilled person to create larger furniture assemblies.

It is a further object of the present invention to provide such a modular table unit which can be constructed of wood so that the furniture assemblies have a pleasing aesthetic appearance compatible with existing furniture in most households.

Other objects, advantages, and features of the present invention will become apparent from the following specification when taken in conjunction with the accompanying drawings.

DETAILED DESCRIPTION OF THE PREFERRED EMBODIMENT

Figure 1:
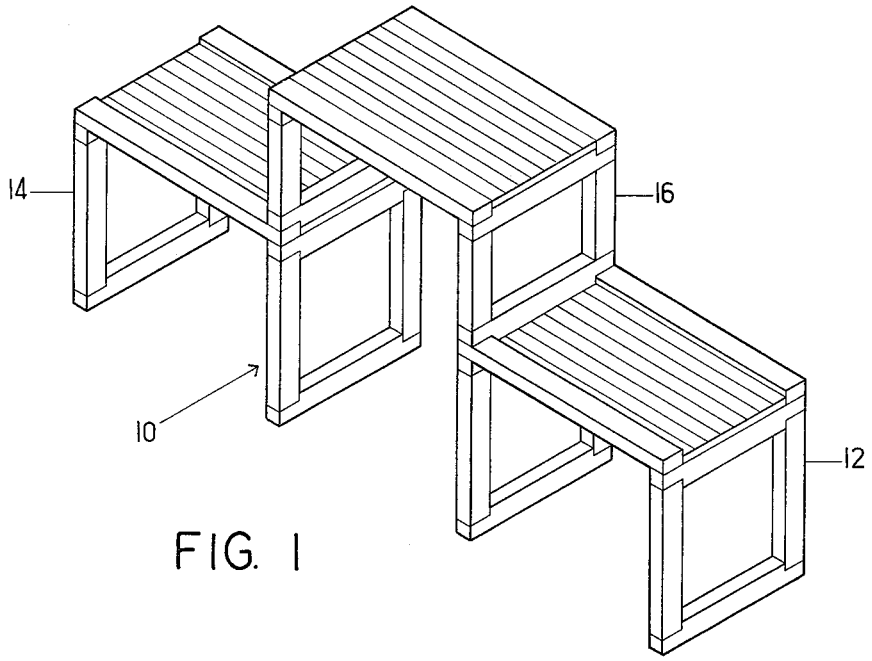
FIG. 1 is a perspective view of a furniture assembly constructed from a plurality of modular table units constructed in accordance with the present invention.

Shown in FIG. 1 and generally illustrated at 10 is a furniture assembly assembled from modular table units constructed in accordance with the present invention. The table assembly 10 is constructed of two similarly sized table units 12 and 14 and one smaller table unit 16 stacked above them. Each of the table units 12, 14 and 16, while varying in the dimension of some of their components, are formed of components which are generally identical in structure. These components may be assembled in various ways either so as to form a generally rectangular modular table unit which may serve as a base unit upon which other units may be stacked, like the table units 12 and 14, or so as to form a stacking unit, such as the table unit 16, which may be stacked upon the base units in a fashion such that it interlocks with the base units to form a stable furniture assembly. The structure of a typical modular table unit will now be described in detail without reference to any one particular of the table units in the assembly 10 of FIG. 1, with it being understood that the different table units 12, 14 and 16 of the table assembly of FIG. 1 are constructed from properly assembled modular units of the type disclosed in FIGS. 2–5 discussed below.

Figure 2:
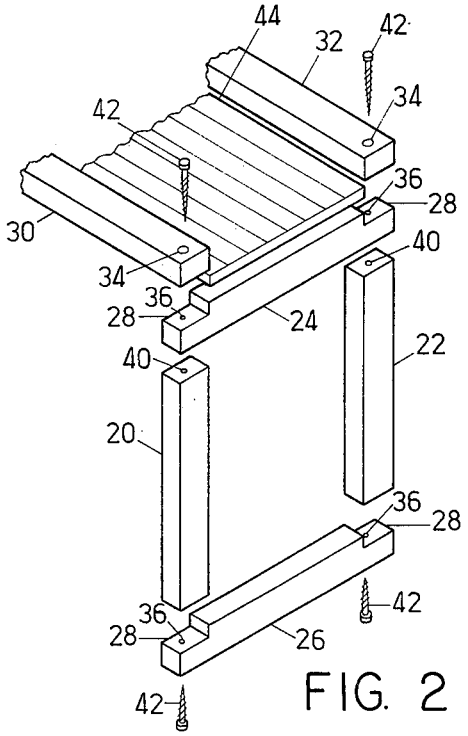
FIG. 2 is an exploded perspective view of the end structure of a one of the modular table units constructed in accordance with the present invention, the elements of the construction being shown as they are configured in assembling a table unit adapted to stand alone.

Shown in FIG. 2 is an exploded end view of a modular table unit constructed in accordance with the present invention. While only one end of the table unit is shown in FIGS. 2–5, it is to be understood that the other end of each of the respective table units is similar in construction and is typical of other modular table units constructed in accordance with the present invention. The table unit as shown in FIG. 2 includes a pair of upstanding vertically oriented legs 20 and 22. The legs 20 and 22 are elongated members square in cross-sectional shape. Extending between the tops and the bottoms of the legs 20 and 22 respectively are horizontally oriented top and bottom end cross bars 24 and 26. Each of the end cross bars 24 and 26 has formed at its opposite ends a pair of rabbetted recesses 28 sized so as to correspond to the cross-sectional size and shape of the upstanding legs 20 and 22 of the table end assembly. Extending across the sides of the table unit to the opposite end thereof, and perpendicular to the top and cross bar 24, are a pair of generally horizontal side bars 30 and 32. The side bars 30 and 32 are similar in width to the legs 20 and 22 so that they may also be received in the rabbetted recesses 28 formed at the opposite ends of the top end cross bar 24. Each of the side bars 30 and 32 has formed in it adjacent to its end a countersunk drill hole 34 extending therethrough. Each of the end cross bars 24 and 26 is provided at each of its ends, centrally located in the respective rabbetted recess 28, a drill hole 36 extending completely therethrough. The drill hole 36 is countersunk on only one side of each cross bar 24 and 26, the side away from the rabbetted recesses 28. Each end of each of the legs 20 and 22 is also provided with a drilled bore 40. The countersunk drill holes 34 are positioned in the end of each of the side bars 30 and 32 so that they can be aligned linearly with the drill holes 36 and drilled bores 36 provided in the top cross bar 24 and the legs 20 and 22 respectively. A pair of threaded fasteners 42 are provided to extend through the holes 34 and 36 and into the bores 40 in the tops of the legs 20 and 22 while another pair of threaded fasteners 42 are provided to extend through the holes 36 in the bottom end cross bar 26 into the bores 40 in the bottoms of the legs 20 and 22. The threaded fasteners 42 may be conventional round headed wood screws and the pair of fasteners 42 for the top of the table unit end assembly, i.e., extending through the side bars 30 and 32, may be somewhat longer than the fasteners 42 provided for the bottom of the table unit end assembly. A planar member 44, which is simply a rigid rectangular sheet of material, is positioned on top of the table unit, supported at its ends by the top end cross bars 24 and restrained in place by the side bars 30 and 32.

The assembly of the end of the modular table unit as shown in FIG. 2 is a configuration which is to be utilized wherein the table is to be used alone, i.e., not assembled in combination with other modular table units constructed according to the present invention. In assembling the end unit as shown in FIG. 2, the bottom ends of each of the legs 20 and 22 is positioned in the upwardly oriented rabbetted recesses 28 provided in the bottom end cross bar 26 while the ends of the side bars 30 and 32 are received in the upwardly oriented rabbetted recesses 28 provided in the top end cross bar 24. The bottom, planar end of the top cross bar 24 sits atop the tops of the legs 20 and 22. The threaded fasteners 42 are then driven through their appropriate holes to assemble the end of the table unit in the fashion shown in FIG. 2. The planar member 44 is then placed between the side bars 30 and 32 with its ends resting atop the end cross bars 24 at opposite ends of the table unit to complete the table unit.

Figure 3:
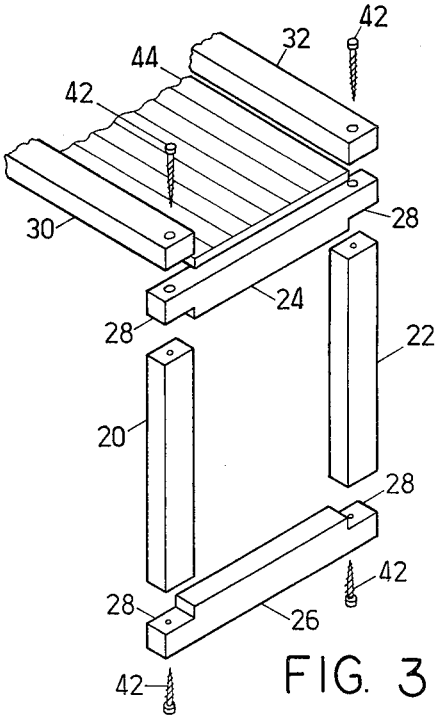
FIG. 3 shows an exploded perspective view, similar to FIG. 2, in which the elements are configured so as to receive another modular table unit thereabove.
Figure 4:
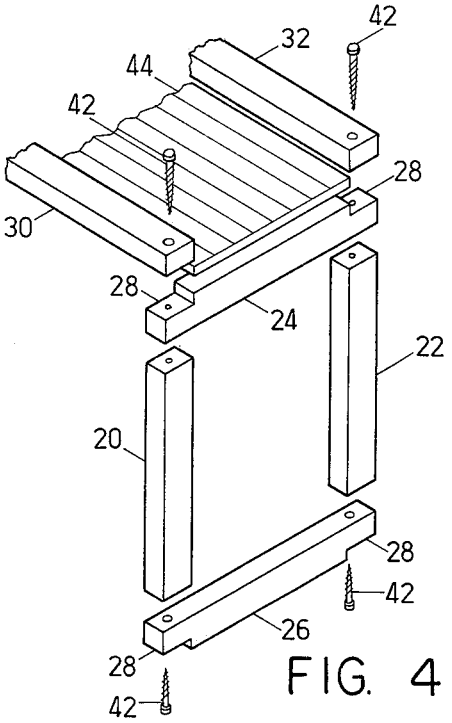
FIG. 4 is an exploded perspective view, similar to FIG. 2, of an assembly in which the components are assembled so as to interlock with another modular table unit located therebelow.
Figure 5:
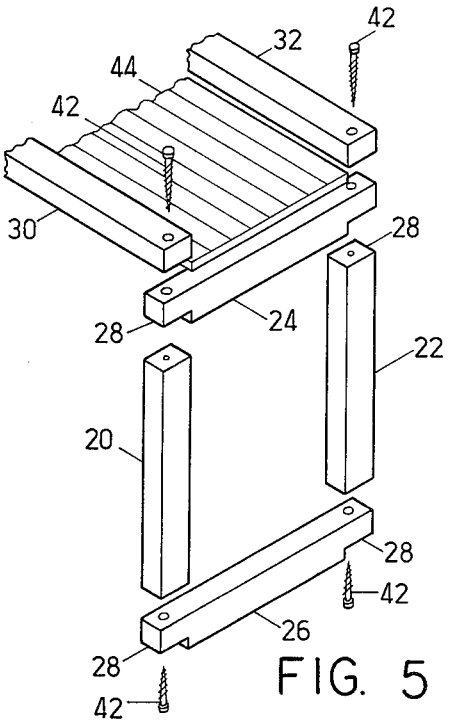
FIG. 5 is an exploded perspective view, similar to FIG. 2, with the elements of the assembly oriented so as to interlock with other modular table units both below and above.

Shown in FIGS. 3–5 are alternative table unit end assemblies using the same components as the table end assembly illustrated in FIG. 2, with the configuration of the various elements altered so that the table end assemblies of FIGS. 3–5 are adapted to being used in conjunction with other modular table units. Thus in the embodiment shown in FIG. 3, all of the components of the end table assembly as shown in FIG. 2 are similarly positioned and attached to each other with the single exception being that the top end cross bar 24 is inverted so that the rabbetted recesses 28 thereon are oriented downwardly so that they receive the tops of the legs 20 and 22, rather than receiving the ends of the side bars 30 and 32 as in FIG. 2. The table unit assembly configuration as illustrated in FIG. 3 is intended to provide a gap between the ends of the side bars 30 and 32 above the top end cross bar 24. This gap is provided so that another table unit may be stacked upon the table unit of FIG. 3 interfitting into that gap. This gap created by the inversion of the top end cross bar 24 is contrasted with the assembly shown in FIG. 2 in which the top of the planar member 44, when resting atop the top end cross bar 24, is flush with the tops of the side bars 30 and 32.

Shown in FIG. 4 is another alternative configuration for the end construction of the table unit of FIG. 2. This configuration is designed to be utilized for a table unit which is to be stacked upon another table unit but which is not to have any table units stacked upon it. The assembly of the parts in this configuration is similar to the mode of assembly illustrated in FIG. 2, with the exception that the bottom end cross bar 26 is inverted so that the rabbetted recesses 28 formed thereon are oriented in a downward rather than upward direction. The top end cross bar 24 remains in its position as shown in FIG. 2. With the bottom end cross bar 26 inverted in this manner, the portion of the bottom cross bar 28 between the rabbetted recesses 28 protrudes downward providing a projection which could interfit with the type of gap created by the inverted top end cross bar 24 as shown in FIG. 3. Thus the assembly as shown in FIG. 4 is designed to be utilized in an application in which a modular table unit is intended to be stacked upon and interlocked with another modular table unit.

Shown in FIG. 5 is another alternative configuration for assembly of the parts of the modular table unit as illustrated in FIGS. 2–4. The configuration of FIG. 5 is utilized when it is desired that a modular table unit stack upon another modular table unit and also have a third modular table unit stacked upon it. Thus, in the configuration as shown in FIG. 5, both the top and bottom end cross bars 24 and 26 are inverted with respect to their positions as shown in FIG. 2, i.e., both have their rabbetted recesses 28 oriented downwardly. The inversion of the bottom cross bar 26 creates a downwardly protruding projection in between the recesses 28 while the inversion of the top end cross bar 24 creates a gap between the ends of the side bars 30 and 32. The projection formed by the inverted bottom end cross bar 26 is exactly complementary in size and shape to the gap formed between the ends of the side bars 30 and 32 when the top end cross bar 24 is inverted as shown in FIG. 5. Thus the table unit assembly configuration of FIG. 5 is intended to be utilized in an application in which the modular table unit stacks upon another modular table unit and in which an additional modular table unit is stacked thereupon.

Thus, referring again to the furniture assembly 10 illustrated in FIG. 1, the modular table unit 12 and the modular table unit 14 are constructed in the configuration illustrated in FIG. 3 while the modular table unit 16 is assembled in the configuration illustrated in FIG. 4. The projections created by the bottom end cross bars of the table unit 16 nest within the gaps created at the tops of the ends the modular table units 12 and 14. It can be readily seen that by properly assembling the individual modular table units, a wide variation of assemblies can be constructed and stacked upon each other to make furniture assemblies of varying size, shape, and complexity.

Figure 6:
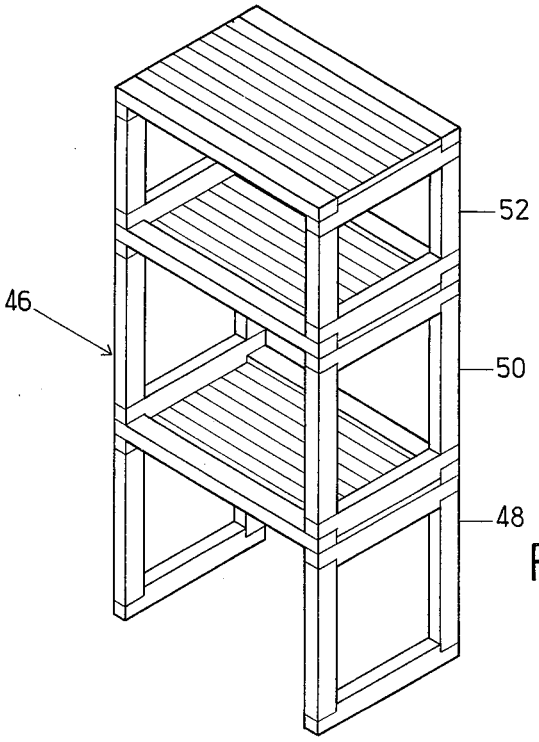
FIG. 6 is another example of a furniture assembly which can be assembled using modular table units constructed in accordance with the present invention.

By way of a further example, another furniture assembly, generally indicated at 46, is shown in FIG. 6.

The furniture assembly 46 is composed of a large lower table unit 48, a large middle table unit 50, and a small upper table unit 52, the lower table unit 48 is assembled in the configuration shown in FIG. 3 while the middle table unit 50 is assembled in the configuration shown in FIG. 5 and the upper unit 52 is assembled as shown in FIG. 4. It can be readily seen that a stable, interlocking assembly is formed that is both sturdy and aesthetically pleasing. It can also be readily seen that a wide variety of alternative assemblies are possible by using any number properly assembled table units.

By using fasteners 42 that have disk-shaped heads, it is also possible to add to the interlocking nature of the stacked table units of the present invention. Note that the holes 34 in the side bars 30 and 32 are countersunk on the tops thereof and the holes 36 in the cross bars 24 and 26 are countersunk on the side of the respective cross bar away from the rabbetted recesses 28. When the bottom cross bar 26 is assembled in its stand-alone configuration, as shown in FIGS. 2 and 3, the head of the fastener 44 is received in the countersunk hole and the bottom of the unit is smooth. By contrast, when the bottom cross bar 26 is assembled in its stacking configuration, as shown in FIGS. 4 and 5, the fastener head protrudes below the surface of the hole 36 in the rabbetted recesses 28. When the units are stacked, these protruding fastener heads are received in the countersinks located in the side bars 30 and 32 of the table unit below to further interlock and stabilize the stacked table units.

It is understood that the present invention is not limited to the particular construction and arrangement of parts disclosed and illustrated herein, but encompasses all such modified forms thereof as come within the scope of the following claims.

I claim:

1. A generally rectangular modular table unit having a pair of sides and a pair of ends comprising:

a pair of generally horizontal side bars (30, 32) disposed along the sides of the unit;

a planar member (44) positioned between the side bars (30, 32) forming a top for the unit;

a pair of generally vertical legs (20, 22) at each end of the unit, each of the legs (20, 22) positioned under an end of one of the side bars (30, 32); and a top and bottom cross bar (24, 26) at each end of the unit, each cross bar (24, 26) positioned horizontally across the respective end of the unit extending between the legs (20, 22) at that end, each of the cross bars (24, 26) having formed on one face thereof a pair of rabbetted recesses (28), each recess (28) located at an end of the respective cross bar (24, 26), and each of the cross bars (24, 26) being fastenable to the adjacent legs (20, 22) in one of two configurations, one configuration being with the recesses (28) oriented downwardly so as to form an interlocking structure to aid in stacking the units, the other configuration being with the recesses (28) oriented upwardly so as to form a structure adapted for standing alone.

2. A modular table unit as claimed in claim 1 wherein the legs (20, 22) are similar in width to the side bars (30, 32) so that either may be received in the recesses (28) in the cross bars (24, 26).

3. A modular table unit as claimed in claim 1 wherein fasteners (42) are provided extending downwardly through the ends of the side bars (30, 32) and the top cross bar (24), and into the top ends of the legs (20, 22) at the top of each end of the unit, and wherein fasteners (42) are provided extending upwardly through the bottom cross bar (26) and into the bottom ends of the legs (20, 22) at the bottom of each end of the unit.

4. The modular table unit as claimed in claim 3 wherein the top and bottom cross bars (24, 26) and the legs (20, 22) are provided with drilled holes (36, 40) to receive the fasteners (42) therein and wherein the ends of the side bars (30, 32) are provided with countersunk drilled holes (34) to receive the upper fasteners (42) therethrough.

5. The modular table unit as claimed in claim 4 wherein the drilled holes (36) in the cross bars (24, 26) are countersunk only on the side opposite from the rabbetted recesses (28) so that the heads of the fasteners (42) will protude from the bottom of the table unit into the countersinks in the side bars (30, 32) of the table unit next beneath when the table units are stacked.

6. The modular table unit as claimed in claim 1 wherein the unit is constructed entirely of wood.

7. The modular table unit as claimed in claim 1 wherein the top cross bars (24) are positioned with their recesses (28) oriented downwardly and the bottom cross bars (26) are positioned with their recesses (28) oriented upwardly so that the unit is adapted to receive another table unit stacked thereupon and is also adapted to resting on a flat surface.

8. The modular table unit as claimed in claim 1 wherein the top cross bars (24) are positioned with their recesses (28) oriented upwardly and the bottom cross bars (26) are positioned with their recesses (28) oriented downwardly so that the unit is adapted to stacking upon another table unit but has a flat upper surface itself.

9. The modular table unit as claimed in claim 1 wherein the top cross bars (24) and the bottom cross bars (26) are positioned with their recesses (28) oriented downwardly so that the unit is adapted to stack upon another table unit and to having another table unit stacked upon it.

10. The modular table unit as claimed in claim 1 wherein the top cross bars (24) and the bottom cross bars (26) are positioned with their recesses (28) oriented upwardly so that the unit is adapted to standing alone.

* * * * *